US005441154A

United States Patent [19]

Youell, III

[11] Patent Number: 5,441,154

[45] Date of Patent: Aug. 15, 1995

[54] INTEGRATED PAPERBOARD CONTAINER AND PALLET SYSTEM

[76] Inventor: Donald R. Youell, III, 5913 MacEwen Ct., Dublin, Ohio 43017

[21] Appl. No.: 267,884

[22] Filed: Jun. 28, 1994

[51] Int. Cl.[6] ..... B65D 19/20

[52] U.S. Cl. ..... 206/599; 108/51.3; 108/55.5; 206/386; 206/600; 493/137

[58] Field of Search ..... 206/386, 595-600; 108/51.3, 55.1, 55.3, 55.5; 493/137

[56] References Cited

U.S. PATENT DOCUMENTS

| | | | |
|---|---|---|---|
| 3,719,342 | 3/1973 | Kupersmit | 108/55.1 |
| 4,121,732 | 10/1978 | Hickey | 206/597 |
| 4,306,665 | 12/1981 | Hickey | 206/600 |
| 4,503,973 | 3/1985 | Anderson | 206/600 |
| 4,785,957 | 11/1988 | Beck et al. | 206/600 |
| 4,976,353 | 12/1990 | Halliday | 206/386 |
| 5,269,455 | 12/1993 | Grigsby et al. | 206/386 |

FOREIGN PATENT DOCUMENTS

| | | | |
|---|---|---|---|
| 2038278 | 7/1980 | United Kingdom | 206/600 |
| 2085545 | 4/1982 | United Kingdom | 206/598 |
| 2213798 | 8/1989 | United Kingdom | 206/600 |

*Primary Examiner*—Jimmy G. Foster
*Attorney, Agent, or Firm*—Mueller and Smith

[57] ABSTRACT

An integrated paperboard container and pallet system. A wall portion is provided as having upstanding walls which are spaced-apart to form a generally polygonal-shaped interior cavity. At least one of the walls is formed as having at least one side tab extending downwardly therefrom. A deck portion is provided as a generally planar member having an upper side forming a floor surface and a lower side forming a support surface. The planar member has edges forming a generally polygonal periphery and first openings therethrough for each side tab. A first and a second runner further are provided as each having a top wall. Each top wall is attached to the lower support surface of the deck portion for supporting the deck portion therebetween, and is formed as having a slot therethrough for and in registry with each corresponding first opening of the deck portion. Each side tab is received through a corresponding first opening of the deck portion and into the registered slot of a runner to attach the wall portion to the floor surface of the deck portion.

29 Claims, 5 Drawing Sheets

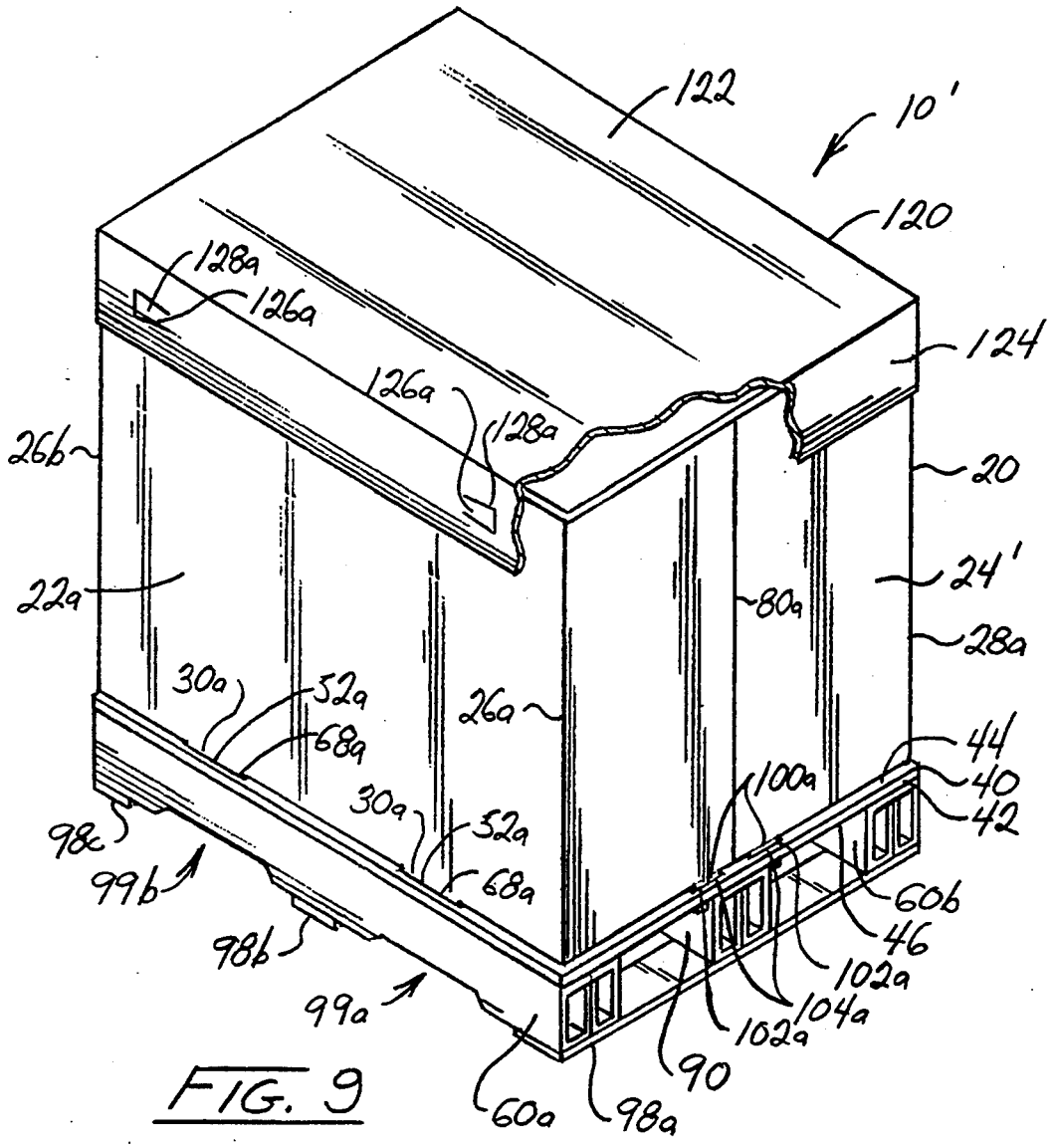
FIG. 9
FIG. 10
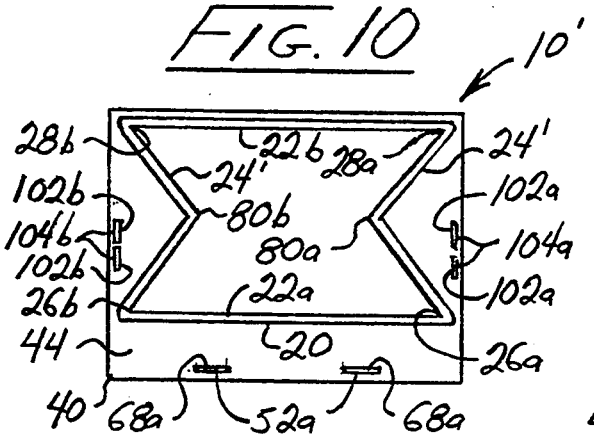
FIG. 11
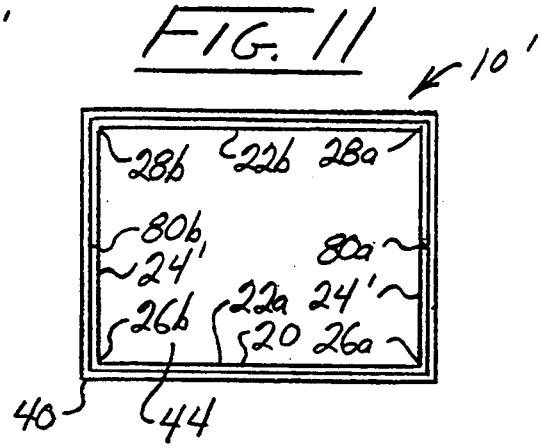

INTEGRATED PAPERBOARD CONTAINER AND PALLET SYSTEM

BACKGROUND OF THE INVENTION

The present invention relates generally to paperboard containers and pallets, and more particularly to an integrated paperboard container and pallet system having a collapsible walled section facilitating the shipping of the system when unassembled.

Heretofore, pallets used by the shipping industries for the storage or transportation of a variety of goods generally have been constructed out of a wood material. These wooden pallets, however, are known to have a definite usable life, and, thereafter, must be disposed of in an acceptable manner such as in a landfill or the like. Increasingly, the use of wooden pallets has become an environmental issue as the amount of usable landfill space continues to decline. The disposal problem is magnified when it is considered that large assembly plants, such as automobile plants and the like, generated literally thousands upon thousands of wooden pallets.

In anticipation of the passages of laws or regulations proscribing against the disposal of wooden pallets in landfills, the art has turned to pallets fabricated of paperboard materials such as corrugated cardboard and the like, which are generally considered to be more recyclable than wood. Paperboard pallets of such a type are described in Youell, Jr., et al., U.S. Pat. No. 5,222,444, the disclosure of which is expressly incorporated herein by reference. One such pallet utilizes runners which comprise a sheet of paperboard that has been folded into a rectangular form having top and bottom walls, a pair of sidewalls, and a central vertical wall interposed between the sidewalls. The top wall has cutout areas or openings, and the central wall has quarter-round cutouts located at the longitudinal ends of the top wall cutout areas. The top wall cutout areas are adapted to receive flaps formed as having central slots. The flaps are selected from: flaps formed or cut from the runner top wall; flaps formed or cut from an upper deck attached to the runner; or flaps cut from a rectangular insert which has a pair of end slotted flaps, which insert fits into the top wall cutout with the end slotted flaps folding downwardly into the quarter-round cutouts.

Another pallet described in U.S. Pat. No. 5,222,444 utilizes a runner comprising sheet of paperboard that has been folded into a rectangular form by one end being folded to form a first bottom wall, a first sidewall, a first top wall, and a second sidewall; and the other end being folded into an "S" configuration to form a central vertical wall, a partial second top wall which underlies the first top wall, and a partial second bottom wall which underlies the first bottom wall. The top wall has cutout areas or openings, and the central vertical wall has quarter-round cutouts located at the longitudinal ends of the top wall cutout areas. The top wall cutout areas adapted to receive flaps formed as having central slots. The flaps are selected from: flaps formed or cut from the runner top wall; flaps formed or cut from an upper deck attached to the runner; or flaps cut from a rectangular insert which has a pair of end slotted flaps which insert fits into the top wall cutout with the end slotted flaps folding downwardly into the quarter round cutouts.

Advantages of the pallets exemplified in U.S. Pat. No. 5,222,444 include paperboard pallets which are inexpensive to produce, and yet which are completely recyclable. A further advantage is pallets having a capability for beating heavy loads which still possess lateral stability. Another advantage is a pallet and runner construction which is collapsible for efficient storage and shipment, but which may be assembled easily for use.

Paperboard runners and pallets such as those of the types described in U.S. Pat. No. 5,222,444 have become increasingly embraced by the shipping and manufacturing industries as offering acceptable substitutes for wooden pallets. Accordingly, there have been calls to extend the applications for such runners and pallets for the shipping of other types of products, such piece parts and the like, requiring the provision of a container. Particularly desired has been the replacement of the ubiquitous banded containers which heretofore could be considered an industry standard. Such containers, which may be constructed of paperboard or the like, generally involve a tubular wall section interposed between flanged top and bottom sections. Metal or plastic bands are strapped around the flanges to secure the assembly, and may be strapped around the wall section to increase the strength and rigidity thereof. Additional bands may be strapped crosswise around the top and bottom sections, and may be used to secure the container to a wooden pallet or the like. This banding constitutes a significant raw material expense in the production of the container, increases the labor costs associated with the assembly of the container, and may increase the expenses associated with the disposal of the containers as the bands generally are considered less recyclable than the paperboard portions of the container. Moreover, the necessity of having to use a separate pallet with the banded containers additionally increases both raw material and disposal costs.

In view of the foregoing, it is apparent that alternatives to the banded containers heretofore known in the art would be well-received by the shipping and manufacturing industries. A preferred alternative would incorporate the advantages of the paperboard pallets described hereinbefore in being inexpensive, recyclable, and easy to assembly, and desirably would be collapsible for efficient storage and shipment.

BROAD STATEMENT OF THE INVENTION

Broadly, the present invention is directed to paperboard containers and pallets, and more particularly to a paperboard pallet having an attached container. One aspect of the invention therefore involves an integrated paperboard container and pallet system. The container component of the integrated system is formed of wall portion which is provided as having upstanding walls which are spaced-apart to form a generally polygonal-shaped interior cavity. At least one of the walls is formed as having at least one side tab extending downwardly therefrom. For forming the deck of the pallet component and the floor of the container component, a deck portion is provided as a generally planar member having an upper side forming a floor surface and a lower side forming a support surface. The planar member has edges forming a generally polygonal periphery and first openings therethrough for each side tab. The pallet component further is formed of a first and a second runner, each of which, in turn, is formed as having a top wall. Each top wall is attached to the lower support surface of the deck portion for supporting the deck portion therebetween, and is provided with a slot therethrough for and in registry with each corresponding first opening of the deck portion. For integrating the container and pallet components of the system, each side tab is received through a corresponding first opening of the deck portion and into the registered slot of a runner to attach the wall portion to the floor surface of the deck portion.

A further aspect of the present invention involves a method of making an integrated container and pallet. For forming the container component of the integrated system, an upstanding wall portion is provided as having a pair of oppositely-disposed side walls, and a pair of oppositely-disposed end walls each extending between the side walls intermediate a first and a second edge fold line. Each of the side walls is formed as having at least one side tab extending downwardly therefrom. Each of the end walls is formed as having a central vertical fold line disposed intermediate the first and the second edge fold line, and is inwardly folded on the central and the first and second edge fold lines collapsing the wall portion. For forming the deck of the pallet component and the floor of the container component, a deck portion is provided as formed of a generally planar member having an upper side forming a floor surface and a lower side forming a support surface. The planar member has edges forming a generally polygonal periphery, and has first openings therethrough, each of the first openings being disposed along one of a first pair of opposite edges of the polygonal periphery and in correspondence with a side tab. A first and a second runner are provided for further forming the pallet, each runner being formed as having a top wall. Each top wall is attached to the lower support surface of the deck portion along one of the first pair of opposite edges thereof and has a slot therethrough for and in registry with each corresponding first opening of the deck portion. For integrating the container and pallet components provided, each of the side tabs from one of the side walls is inserted through a corresponding first opening of the deck portion and a slot of a runner. The collapsed wall portion then is outwardly expanded about each central and each first and second edge fold line to space apart the side and the end walls. Lastly, each side tab of the other side wall is inserted through a corresponding first opening of the deck portion and slot of the other runner to attach the wall portion to the floor surface of the deck portion forming the integrated container and pallet.

Advantages of the present invention include the provision of an integrated paperboard pallet and container which is inexpensive to produce, and yet which possesses lateral stability without banding for bearing heavy loads. Another advantage is a construction that is collapsible for storage and shipment, but which can be assembled rapidly and easily for use. A further advantage is a system which is completely recyclable. These and other advantages will become readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein:

FIG. 9 is a partially-fragmentary, perspective view of an alternative embodiment, as assembled, of an integrated container and pallet of the present invention formed has having substantially planar end walls;

FIG. 10 is a schematic top view showing the assembly of the integrated container and pallet system of FIG. 9 commencing with the insertion of the side tabs of a first side wall into corresponding openings in the deck portion and corresponding slots in a first runner;

FIG. 11 is a schematic top view showing the assembly of the integrated container and pallet system of FIG. 5 concluding with the insertion of the side tabs of a second side wall and the end tabs of the end walls into corresponding openings in the deck portion and corresponding slots in a second and a central runner;

The drawings will be described further in connection with the following Detailed Description of the Invention.

DETAILED DESCRIPTION OF THE INVENTION

Figure 1:
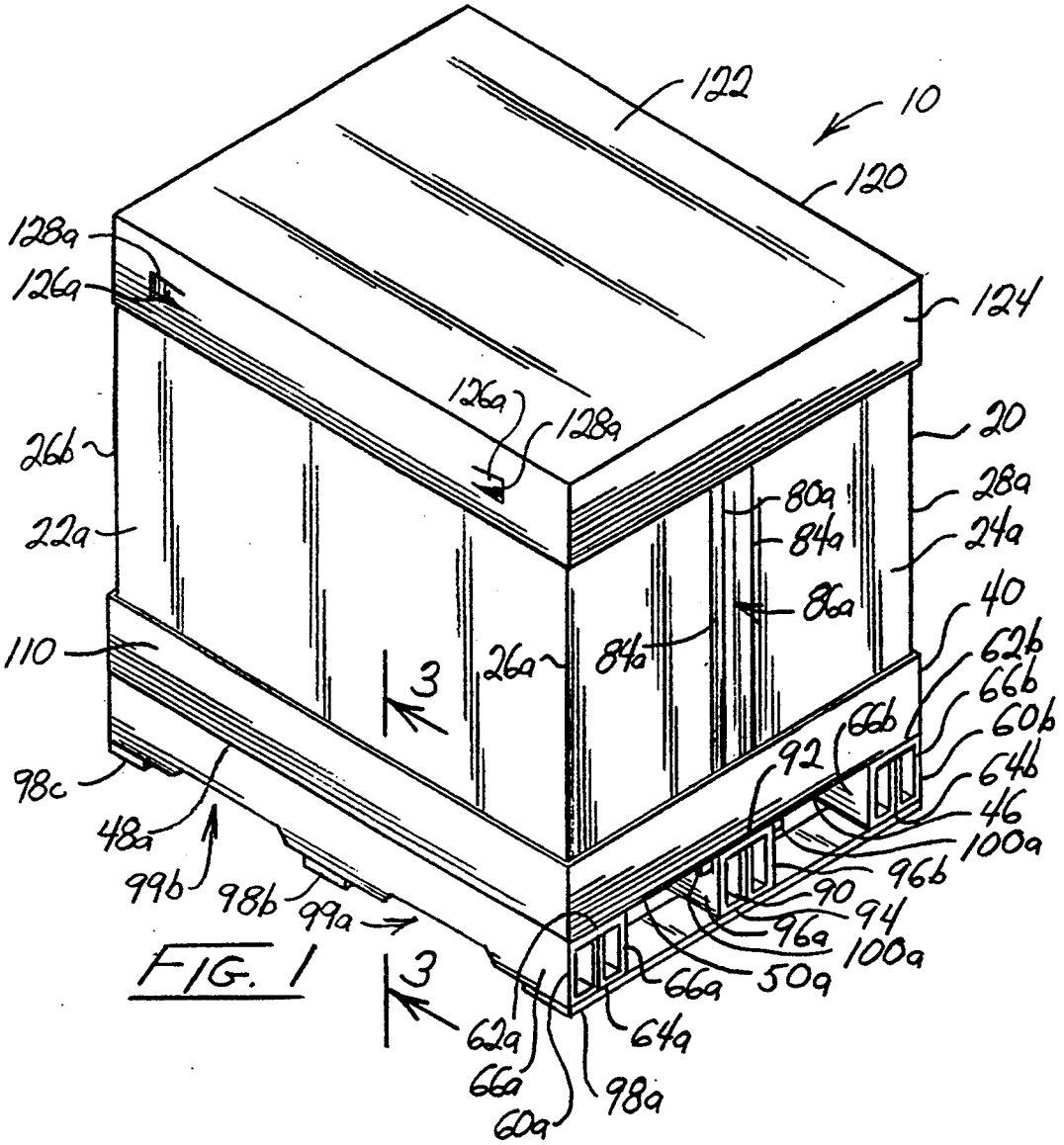
FIG. 1 is a perspective view of an assembled integrated container and pallet of the present invention formed has having a planar deck portion, at least a pair of paperboard runners attached to the deck portion, and an upstanding wall portion having end and side walls and at least one side tab extending downwardly from each side wall into an engagement with a corresponding slot of a runner.
Figure 2:
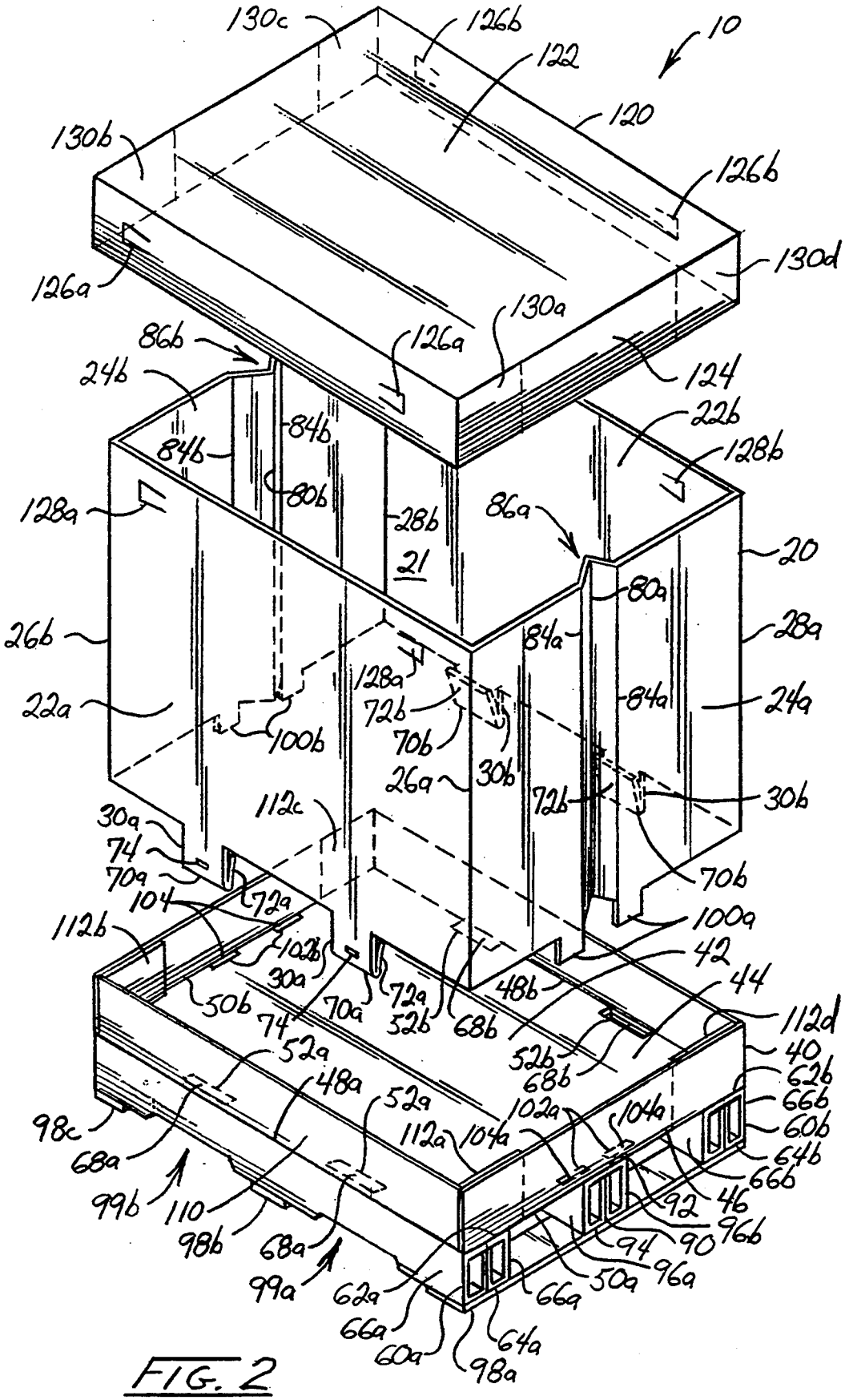
FIG. 2 is an exploded view illustrating the assembly and relationship of the deck portion, runners, and wall portion components comprising the integrated container and pallet of FIG. 1.

Referring initially to FIGS. 1 and 2, a system for constructing an integrated paperboard container and pallet in accordance with the present invention is shown generally at 10 to comprise an upstanding wall portion, 20, a deck portion, 40, and a first and a second runner, 60*a* and 60*b*. Broadly, wall portion 20 is provided as forming with deck portion 40 the container component of system 10, with runners 60 being provided for supporting deck portion 40 therebetween and forming the pallet component therewith. In this manner, an integrated paperboard container and pallet is formed which obviates the necessity and expense of having to provide separate containers and pallets for shipping piece parts or the like.

As to the details of the construction of system 10, wall portion 20 is provided as having a generally polygonal-shaped interior cavity, 21, formed within a pair of oppositely-disposed, spaced-apart side walls, 22*a* and 22*b*, and a pair of spaced-apart, oppositely-disposed end walls, 24*a* and 24*b*, each extending between side walls 22 intermediate first, 26*a* and 26*b*, and second, 28*a* and 28*b*, edge fold lines. Each side wall 22 of wall portion further is provided has having at least one and, preferably, a pair of side tabs, 30*a* and 30*b*, extending downwardly therefrom.

Although wall portion 20 is illustrated as having a one-piece construction which may be formed from a continuous web of paperboard or the like, it is to be considered within the scope of the present invention to form wall portion 20 form a generally planar blank or blanks having overlapping ends and/or sides which are adhered, attached, or otherwise engaged to form side walls 22 and end walls 24. Walls 22 and 24, alternatively, even may be provided as separate structures, each of which are separately attached to deck portion 40. Indeed, although wall portion 20 is shown as having four walls for forming a generally rectangular interior cavity 21, other configurations, such as the provision of three, five, or six walls for forming, respectively, a generally triangular, pentagonal, or hexagonal interior cavity 21 may be envisioned based upon the present disclosure.

Deck portion 40 is provided as a generally planar member, 42, having an upper side forming a floor surface, 44, for the container component of system 10, and a lower side forming a support surface, 46, for the pallet component. Planar member 42 has edges, 48*a–b* and 50*a–b*, forming a generally polygonal periphery, and is provided with a first set of openings therethrough, 52*a* and 52*b*, for each side tab 30, each of first openings 52 being disposed along an edge 48 in correspondence with side tabs 30. As is shown, the polygonal periphery of planar member 42 may be configured as generally corresponding to the geometry of interior cavity 21. Alternatively, depending upon design considerations or on the particular application involved, the periphery of planar member 42 may be provided to extend further beyond the confines of interior cavity 21.

As to first and second runners 60, each are provided as having a generally rectangular shape with top, 62*a–b*, and bottom, 64*a–b*, walls and a pair of side walls, 66*a* and 66*b*. Each of top walls 62 are attached, preferably with an adhesive or the like, to lower support surface 46 of planar member 42 along one of edges 48. Top walls 62 are provide with a slot, 68*a* and 68*b*, for and in registry with each corresponding first opening 52 of deck portion 40. Although the generally rectangular shape of runners 60 which is illustrated is to be considered preferred, other configurations, such as triangular, pentagonal, or cylindrical may be substituted without departing form the precepts of the invention herein involved.

As to the integration of the container and pallet components of system 10, each side tab 30, in accordance with the precepts of the present invention, is received through a corresponding first opening 52 of deck portion 40 and into a corresponding slot 68 of a runner 60. In this way, wall portion 20 is attached to deck portion 40 and to runners 60, and runners 60 are further attached to deck portion 40 for forming an integrated container and pallet which is inherently sturdy as a result of the interrelationships between its component parts.

Figure 3:
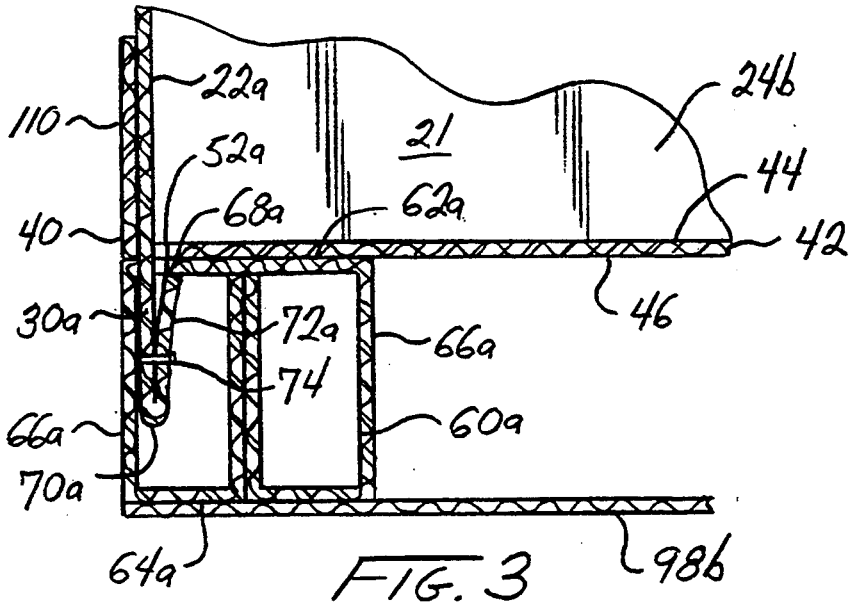
FIG. 3 is a cross-sectional view taken through line 3—3 of FIG. 1 illustrating a substantially locking engagement between a side tab of a side wall and a corresponding slot of a runner.

Looking additionally to FIG. 3, illustrated in enhanced detail is a preferred arrangement for the receiving of each side tab 30 through a corresponding first opening 52 and a corresponding slot 68. In the preferred arrangement, each side tab 30 is folded horizontally about a lower fold line, 70*a* and 70*b*, to form a generally upstanding retention member, 72*a* and 72*b*, which is inwardly biased within each corresponding opening 52 and slot 68. It will be appreciated that the inward biasing of each retention member 72 delimits the removal of each side tab 30 out of each corresponding opening 52 and slot 68 and thereby effects a substantially locking engagement therebetween. The inward biasing of retention members 72 may be effected by the resiliency of the paperboard used to construct end tabs 30 or, alternatively, may be effected with a biasing member such as the staples 74 shown or a bead of adhesive joining each retention member 72 to each corresponding side tab 30.

Returning to FIGS. 1 and 2, a preferred embodiment of system 10 is shown wherein each of end walls 24 is formed as having a central vertical fold line, 80*a* and 80*b*, disposed intermediate each first and second edge fold lines 26 and 28. As best may be appreciated through momentary reference to FIG. 4, prior to the attachment of wall portion 20 to floor surface 44 of deck portion 40, each end wall 24 thereof is inwardly foldable on a central fold line 80 and on a first and second edge line 26 and 28 for collapsing wall portion 20. In this regard, wall portion 20 advantageously is configured as having an outer periphery, represented at 82 of FIG. 4, such that it is receivable in a collapsed orientation within the generally polygonal periphery of deck portion 40. Such an arrangement will be appreciated to facilitate shipping or storage of system 10 in an unassembled configuration which minimizes the total volume thereof.

End walls 24 also are formed, preferably, as further having a pair of corrugation lines, 84*a* and 84*b*, disposed intermediate first and second edge fold lines 26 and 28. With each of the central vertical fold lines 80 disposed intermediate a corresponding pair of corrugation lines 84, each of end walls 24 is provided to be inwardly foldable thereon for forming the corrugated end wall portions shown at 86*a* and 86*b*. Corrugated end wall portions 86 advantageously reinforce the rigidity of wall portion 20 by increasing the lateral stability of end walls 24.

The preferred embodiment of system 10 shown in FIGS. 1 and 2 additionally is provided with at least one central runner, 90, preferably having a generally rectangular shape formed of a top wall, 92, and a bottom wall, 94, and a pair of side walls, 96*a* and 96*b*. Although only one is shown, it will be appreciated that additional central runners 90 may be employed depending upon size and load considerations. As were top walls 62 of runners 60, top wall 92 is attached, preferably with an adhesive or the like, to lower support surface 46 of planar member 42 intermediate and substantially parallel to runners 60. Central runner 90 optionally may be joined to runners 60 via a number of stringers, three of which are shown at 98*a–c*, which extend generally orthogonally between runners 60 and 90. Further, and as is shown at 99*a* and 99*b* for first runner 60*a*, each of runners 60 and 90 may be formed as having side walls 66 and 96, and bottom walls 64 and 94 which are notched to receive the fork of a forklift (not shown) for lifting or moving system 10 and its contents. With spaces being provided between runners 60 and central runner 90, and with notches 99 being formed therethrough, it will be appreciated that the pallet component of system 10 may be accessed from any direction.

For attaching end walls 24 at opposite ends of central runner 90, end walls 24 each may be formed as having at least one and, preferably, a pair of end tabs, 100*a* and 100*b*, extending downwardly therefrom on opposite sides of each corresponding pair of corrugation lines 84. For receiving each of end tabs 100, planar member 42 of deck portion 40 is provided with a second set of openings therethrough, 102*a* and 102*b*, each being disposed along an edge 50 thereof in correspondence with end tabs 100. Further in this regard, top wall 92 is provided with a slot, 104*a* and 104*b*, for and in registry with each second opening 102 of deck portion 40. With deck portion 40 and central runner 90 configured as described, each end tab 100 may be received through a corresponding second opening 102 and into a corresponding slot 104 to thereby attach end walls 24 to the floor surface 44 of deck portion 40 and to central runner 90. As is shown, and depending upon the width of top wall 92 of central runner 90 in relation to the width of end tabs 100 and the spacing therebetween, each of end tabs 24 may partially extend outwardly from central runner 90, or, alternatively, may be received completely therewithin. The attachment of end walls 24 to deck portion 40 in the manner described will be appreciated as further enhancing the lateral stability of wall portion 20.

The lateral stability of wall portion 20 is yet further enhanced via the provision of a first flanged portion, 110, disposed about the polygonal periphery of deck portion 40 and extending upwardly from the floor surface 44 thereof. As may be seen with momentary reference to FIG. 3, flanged portion 110 is configured to receive a portion of wall portion 20 therewithin. Such an arrangement will be appreciated to improve the resistance of walls 22 and 24 to lateral loadings from within cavity 21, and to thereby obviate the need to band or strap wall portion 20. Preferably, deck portion 40 is integrally formed from a generally planar blank which, as is shown by flaps 112*a–d*, has been folded to form planar member 42 and upstanding flanged portion 110.

Concluding the description of FIGS. 1 and 2, the preferred embodiment of system 10 illustrated therein lastly may be seen as further comprising a cover portion, 120, surmounting upstanding wall portion 20 and having a planar cover surface, 122, with a generally polygonal margin and a second flanged portion, 124, disposed therealong and extending downwardly therefrom. Range portion 124 is configured to receive a portion of upstanding wall portion 20 therewithin to effect the enclosure of cavity 21, and may be provided with pairs of thumb tabs, 126*a* and 126*b*, which are insertable into corresponding pairs of locking tabs, 128*a* and 128*b*, provided within side walls 22 and/or end walls 24 (not shown), to effect a locking engagement therebetween securing cover portion 120 to wall portion 20. As was deck portion 40, cover portion 120, preferably, is integrally formed from a generally planar blank which, as is shown by flaps 130*a–d*, has been folded to form planar cover surface 122 and downwardly-extending second flanged portion 124.

Figure 4:
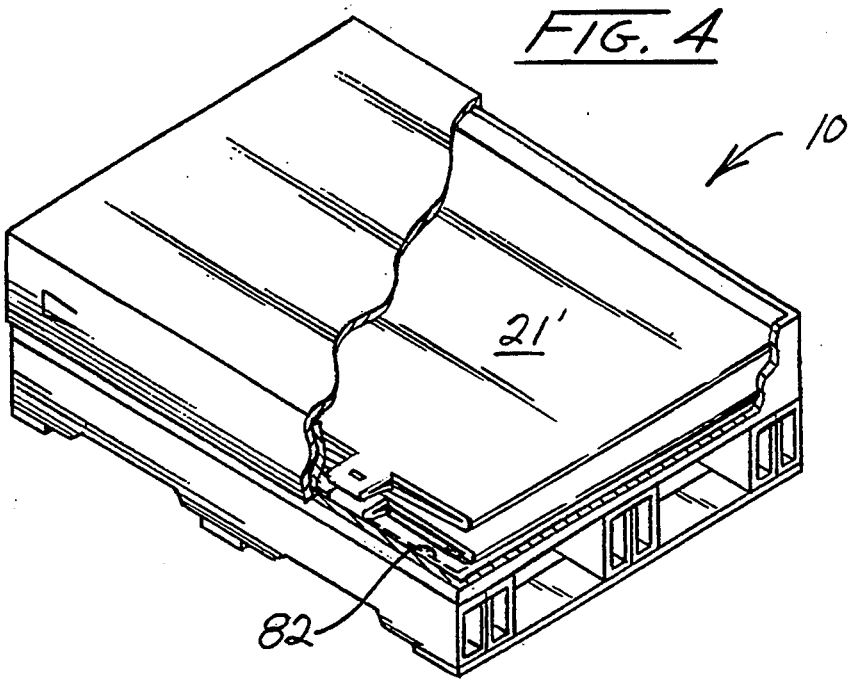
FIG. 4 is a perspective, partially-fragmentary view of the integrated container and pallet of FIG. 1 as collapsed for shipping.
Figure 5:
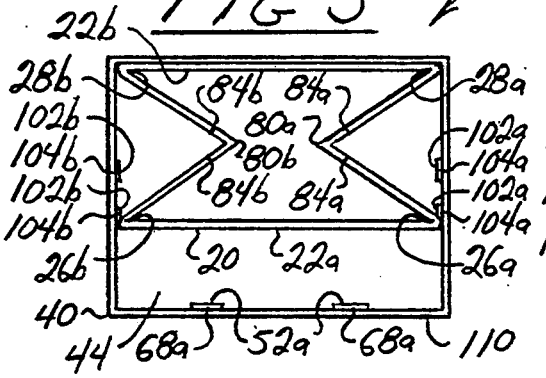
FIG. 5 is a schematic top view showing the assembly of the integrated container and pallet system of FIG. 1 commencing with the insertion of the side tabs of a first side wall into corresponding openings in the deck portion and corresponding slots in a first runner.
Figure 6:
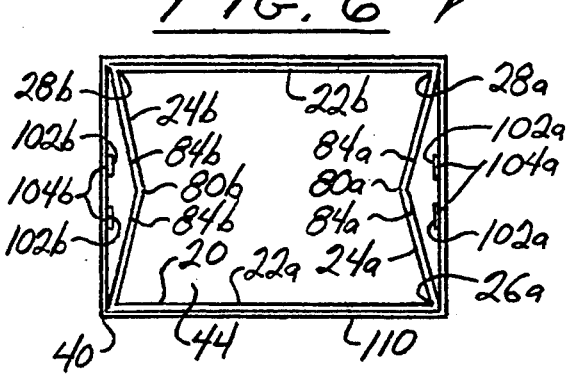
FIG. 6 is a schematic top view showing the assembly of the integrated container and pallet system of FIG. 5 continuing with the insertion of the side tabs of a second side wall into corresponding openings in the deck portion and corresponding slots in a second runner.

Turning next to FIG. 4, wherein system 10 is shown as configured for shipping or storage, it may be seen that second flanged portion 124 of cover portion 120 also may be configured to receive first flanged portion 110 of deck portion 40 therewithin when wall portion 20 is collapsed and disposed within the generally polygonal periphery of deck portion 40. Such configuration decreases the volume of cavity 21 and forms cavity 21' for receiving collapsed wall portion 20. It will be appreciated, however, that as first flanged portion 110 is optional, second flanged portion 120 alternatively may receive deck portion 40, as well as a portion of runners 60 and 90, therewithin. In either arrangement, the collapsed system 10 advantageously is provided to have a minimal total volume facilitating shipping or storage.

Figure 7:
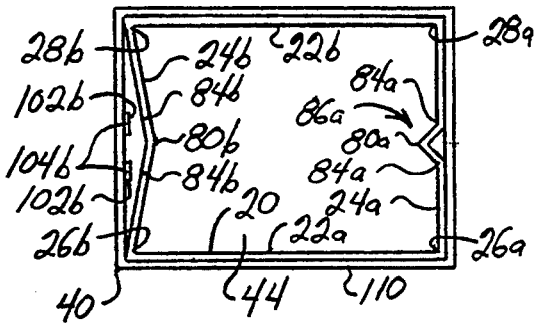
FIG. 7 is a schematic top view showing the assembly of the integrated container and pallet system of FIG. 6 continuing with the insertion of the end tabs of a first end wall into corresponding openings in the deck portion and corresponding slots in a central runner, and the corrugation of the first end wall.
Figure 8:
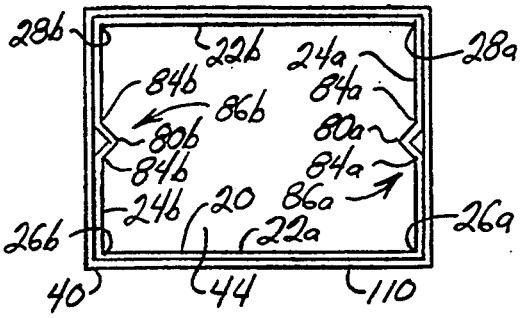
FIG. 8 is a schematic top view showing the assembly of the integrated container and pallet system of FIG. 7 concluding with the insertion of the end tabs of a second end wall into corresponding openings in the deck portion and corresponding slots in the central runner, and the corrugation of the second end wall.

Looking next to FIGS. 5–8, the steps involved in the assembly of integrated container and pallet system 10 are considered. As may be seen in FIG. 5, the assembly commences with the insertion of each side tab 30 from one of side walls 22 through a corresponding first opening 52 in deck portion 40 and a corresponding slot 68 in a runner 60. Thereafter, as in shown in FIG. 6, the collapsed wall portion 20 is outwardly expanded about each central fold line 80 and each corresponding first and second edge fold line 26 and 28 to space apart side walls 22 and end walls 24, with each side tab 30 from the other of side walls 22 being inserted through a corresponding first opening 52 in deck portion 40 and a corresponding slot 68 in the other runner 60. Next, as is shown in FIGS. 7 and 8, each of end tabs 100 of end walls 24 are inserted through a corresponding second opening 102 in deck portion 40 and a corresponding slot 104 in central runner 90, with each end wall 24 being inwardly folded on a corresponding pair of corrugation lines 84 to form corrugated end wall portions 86. Thus, a method of assembling integrated container and pallet system 10 is described which may be quickly and easily effected by a single worker.

Turning next to FIG. 9, and alternative embodiment of system 10 is shown at 10'. In general construction, system 10' is similar to system 10 except that first flanged portion 110 of deck portion 40 is eliminated, and end walls 24, as is shown at 24', are formed without a corresponding pair of corrugation lines 84 and are, therefore, essentially planar with no corrugated end wall portions 86. As may be seen in FIGS. 10 and 11, the assembly of system 10' proceeds essentially as was described in hereinbefore in connection with FIGS. 5–8. In this regard, and as may be seen in FIG. 10, the assembly commences with the insertion of each side tab 30 from one of side walls 22 through a corresponding first opening 52 in deck portion 40 and a corresponding slot 68 in a runner 60. Thereafter, as in shown in FIG. 6, the collapsed wall portion 20 is outwardly expanded about each central fold line 80 and each corresponding first and second edge fold line 26 and 28 to space apart side walls 22 and end walls 24'. As walls 22 and 24' are being spaced apart, each of end tabs 100 are inserted through a corresponding second opening 102 in deck portion 40 and a corresponding slot 104 in central runner 90, and each side tab 30 from the other of side walls 22 is inserted through a corresponding a first opening 52 in deck portion 40 and a corresponding slot 68 in the other runner 60.

Figure 12:
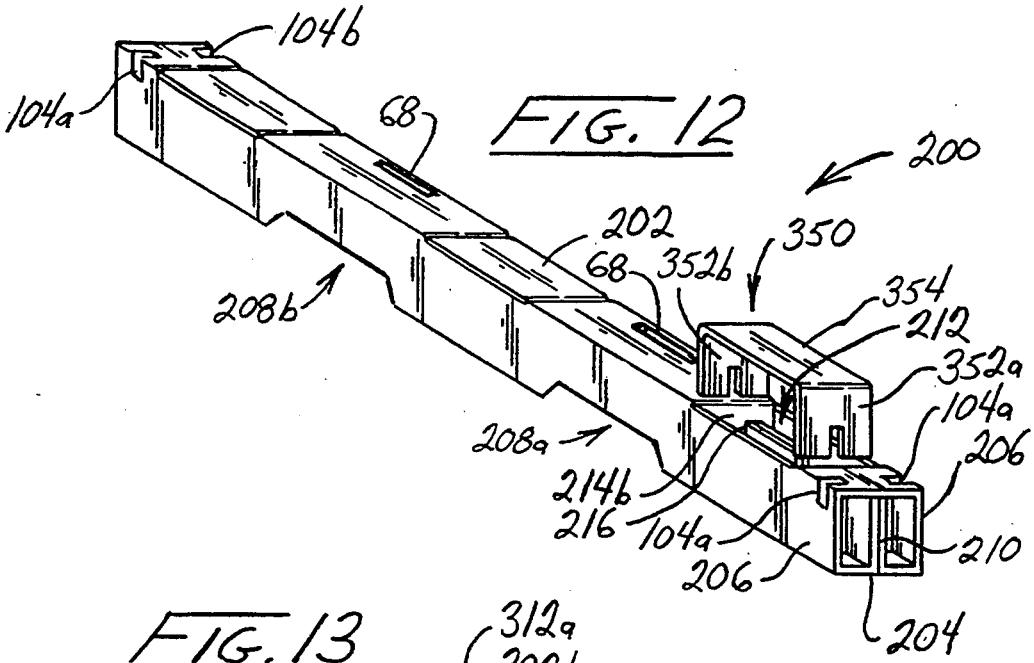
FIG. 12 is a perspective view of one embodiment of a representative paperboard runner adapted for use in the integrated container and pallet system of the present invention.

Referring next to FIG. 12, a representative embodiment of a runner 60 or 90 is shown generally at 200. Preferably, runners 60 and 90 are provided as being identically-formed and interchangeable, thus facilitating their construction from a single blank. Accordingly, runner 200 is formed as having both slots 68 for receiving side tabs 30, and slots 104 for receiving end tabs 100. As previously described in connection with runners 60 and 90, runner 200 is formed as having a generally rectangular shape with a top wall, 202, a bottom wall, 204, and a pair of side walls, 206, with side walls 206 and bottom walls 204 being notched, as is shown at 208*a* and 208*b*, to receive the fork of a forklift (not shown). For added structural rigidity, runner 200 additionally is formed as having a vertical central wall, 210, interposed between side walls 206 and top and bottom walls 202 and 204.

For receiving vertical central wall 210, top wall 202 is provided as having a number openings, one of which is shown at 212, formed from the generally downward disposition of a pair of flaps, one of which is visible at 214*b*, each of which is formed has having a central slot, one of which is visible at 216*b*, which is received by central wall 210. Slots 216 of flaps 214 are provided to engage central wall 210, thereby locking central wall 210 in an upstanding relationship with respect to top wall 202. To facilitate the generally downward disposition of flaps 214 from top wall 202, central wall 210 is formed has having quarter-round cutouts, which may best be seen at 302*a* and 302*b* in FIG. 13 wherein the paperboard blank from which runner 200 is formed is shown generally at 300, located at the longitudinal ends of top wall openings 212. It will be observed that quarter-round cutouts 302 allow for the pivoting of flaps 214 about a pair of score lines 304*a* and 304*b* after blank 300 has been folded into a final configuration wherein central wall 210 is disposed intermediate side walls 206 and top and bottom walls 202 and 204.

Figure 13:
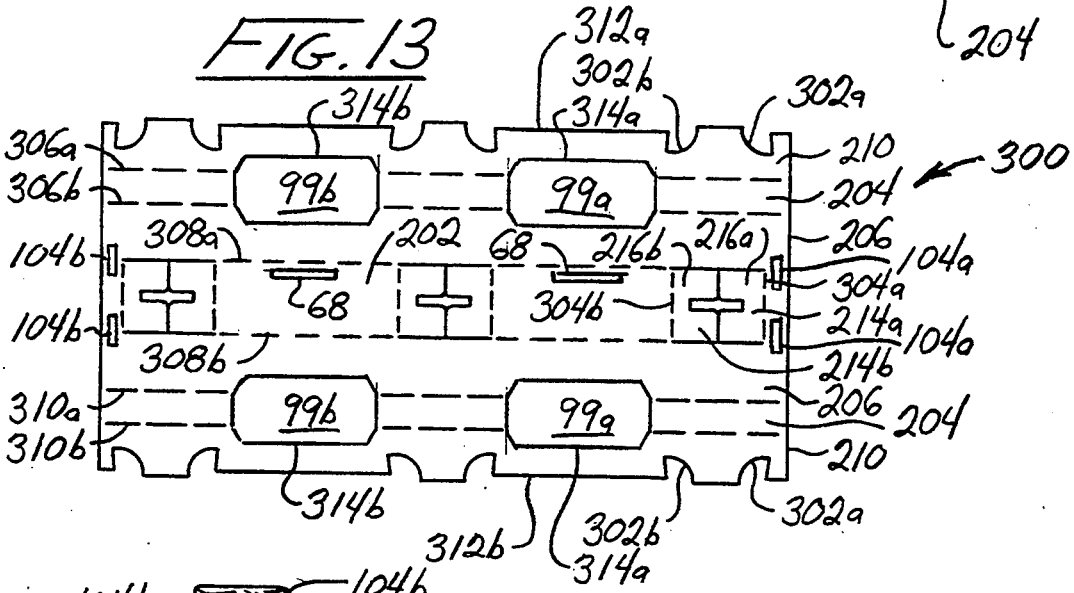
FIG. 13 is a plan view of a paperboard blank which is foldable to form the paperboard runner of FIG. 12.

Continuing then with FIG. 13, blank 300, which may be formed by die cutting a paperboard sheet or the like, is shown as having fold lines, 306*a–b*, 308*a–b*, and 310*a–b*, about which blank 300 is foldable to construct runner 200. In this regard, each of sides 312*a* and 312*b* of blank 300 are mated to form central wall 210. Side walls 206 and top wall 202 are continuously formed, with bottom wall 204 being formed of two individual segments which are placed in an abutting relationship. Openings pairs 314*a* and 314*b* are provided for forming notches 208 in side walls 206 and bottom wall 204.

While the construction of runner 200 thus far described provides a runner which is both sturdy and durable, additional strength, and especially resistance to rolling or lateral deflection, may be gained by the use of the insert shown at 350 in FIG. 12. Insert 350 is provided as being generally U-shaped, and is formed as having a pair of slotted ends, 352*a* and 352*b*, which fit into opening 212 and receive central wall 204. Insert 350 also is provided as having a top surface, 354, which closes openings 212 for forming a continuous top wall 202 in runner 200.

Figure 14:
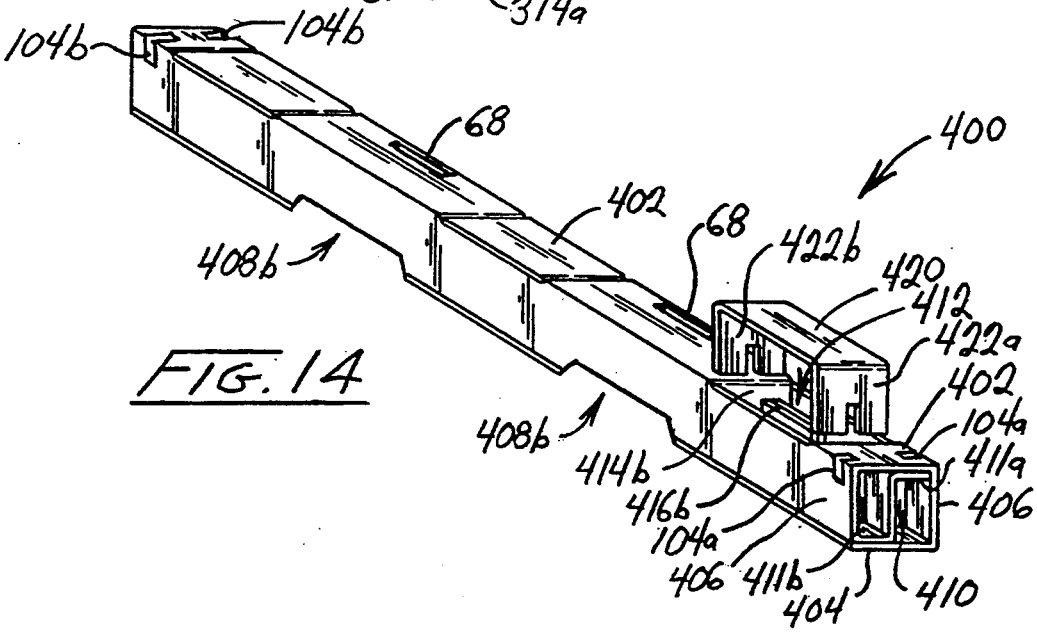
FIG. 14 is a perspective view of an alternative embodiment of a representative paperboard runner adapted for use in the integrated container and pallet system of the present invention.

Looking lastly to FIG. 14, and alternative runner construction is shown at 400 which, again, is formed as having both slots 68 for receiving side tabs 30, and slots 104 for receiving end tabs 100. As previously described in connection with runners 60 and 90, runner 400 is formed as having a generally rectangular shape with a top wall, 402, a bottom wall, 404, and a pair of side walls, 406, with side walls 406 and bottom walls 404 being notched, as is shown at 408*a* and 408*b*, to receive the fork of a forklift (not shown). For structural rigidity, runner 400 additionally is formed as having a vertical central wall, 410, interposed between side walls 406 and top and bottom walls 402 and 404.

Central wall 410 is provided as having a generally S-shaped configuration wherein partial walls 411*a* and 411*b* thereof underlie, respectively, top wall 402 and bottom wall 404. For receiving vertical central wall 410, top wall 402 is provided as having a number openings, one of which is shown at 412, formed from the generally downward disposition of a pair of flaps, one of which is visible at 414*b*, each of which is formed has having a central slot, one of which is visible at 416*b*, which is received by central wall 410. Slots 416 of flaps 414 again are provided to engage central wall 410, thereby locking central wall 410 in an upstanding relationship with respect to top wall 402. To facilitate the generally downward disposition of flaps 414 from top wall 402, central wall 410, as was central wall 210 of runner 200 (FIG. 12), is formed has having quarter-round cutouts located at the longitudinal ends of top wall openings 412. With vertical central wall 410 being formed as shown, runner 400 may be pre-assembled and then collapsed about central wall 410 for shipping or storage. As with runner 200 of FIG. 12, a U-shaped insert, 420, having slotted ends, 422*a* and 422*b*, may be inserted into opening 412 for additional strength.

Runners of the type as described in connection with runners 200 and 400 of FIGS. 12–14 are more fully described in U.S. Pat. No. 5,222,444, the disclosure of which has been expressly incorporated herein by reference.

As to the materials of construction for forming the integrated container and pallet of the present invention, a paperboard or corrugated paperboard material, such as cardboard, pasteboard, fiberboard, or the like is preferred. However, any recyclable material having the necessary strength and rigidity for the particular application envisioned is suitable. As to the preferred paperboard materials, it will be appreciated that the wall construction thereof, i.e., single-ply, double-ply, or higher, may be varied depending upon the application.

It is anticipated that certain changes may be made in the present invention without departing from the precepts herein involved. Accordingly, it is intended that all matter contained in the foregoing description shall be interpreted as illustrative and not in a limiting sense.

What is claimed:

1. An integrated paperboard container and pallet system comprising:

a wall portion having upstanding walls spaced-apart to form a generally polygonal-shaped interior cavity, at least one of said walls having at least one side tab extending downwardly therefrom;

a deck portion formed as a generally planar member having an upper side forming a floor surface and a lower side forming a support surface, said planar member having edges forming a generally polygonal periphery and having a first opening therethrough for each said side tab; and a first and a second runner each formed as having a top wall, each said top wall being attached to said lower support surface for supporting said deck portion between said first and second runner and having a slot therethrough for and in registry with each corresponding said first opening, each said side tab being received through a corresponding said first opening and slot to attach said wall portion to the floor surface of said deck portion.

2. The integrated paperboard container and pallet system of claim 1 wherein:

said wall portion is formed as having a pair of oppositely-disposed, spaced-apart side walls, and a pair of spaced-apart, oppositely-disposed end walls, each of said end walls extending between said side walls intermediate a first and a second edge fold line, and each of said side walls having at least one side tab extending downwardly therefrom;

each said first opening of said deck portion is disposed along one of a first pair of opposite edges of said polygonal periphery; and each said top wall of said first and said second runner is attached to said lower support surface of said deck portion along one of said first pair of opposite edges thereof.

3. The integrated container and pallet system of claim 1 wherein each said side tab is folded horizontally about a lower fold line thereof to form a generally upstanding retention member inwardly biased within each said corresponding first opening and slot, each said retention member delimiting the removal of each said side tab out of each said corresponding first opening and slot for effecting a substantially locking engagement therebetween.

4. The integrated container and pallet system of claim 2 wherein each said side tab is folded horizontally about a lower fold line thereof to form a generally upstanding retention member inwardly biased within each said corresponding first opening and slot, each said retention member delimiting the removal of each said side tab out of each said corresponding first opening and slot for effecting a substantially locking engagement therebetween.

5. The integrated container and pallet system of claim 2 wherein each of said end walls is formed as having a central vertical fold line disposed intermediate said first and said second edge fold line, each of said end walls being inwardly foldable on said central and said first and second edge fold lines for collapsing said wall portion when unattached to the floor surface of said deck portion.

6. The integrated container and pallet system of claim 5 wherein said wall portion is configured as having an outer periphery when collapsed which is receivable within the generally polygonal periphery of said deck portion.

7. The integrated container and pallet system of claim 5 wherein each of said end walls further comprises a pair of corrugation lines disposed intermediate said first and said second edge fold line, each of said central vertical fold lines being disposed intermediate a corresponding said pair of corrugation lines and each of said end walls being inwardly folded thereon forming a corrugated end wall portion.

8. The integrated container and pallet system of claim 2 further comprising at least one central runner having a top wall attached to said lower support surface of said deck portion intermediate and substantially parallel to said first and said second runner.

9. The integrated container and pallet system of claim 8 wherein:

each of said end walls of said wall portion is formed as having at least one end tab extending downwardly therefrom;

said deck portion is formed and having a second opening therethrough for each said end tab, each said second opening being disposed along one of a second pair of opposite edges of said polygonal periphery; and said top wall of said central runner is formed as having a slot therethrough for and in registry with each said second opening, each said end tab being received through a corresponding said second opening and slot attaching the end walls of said wall portion to the floor surface of said deck portion.

10. The integrated container and pallet system of claim 7 further comprising at least one central runner having a top wall attached to said lower support surface of said deck portion intermediate and substantially parallel to said first and said second runner.

11. The integrated container and pallet system of claim 10 wherein:

each of said end walls of said wall portion is formed as having at pair of end tabs extending downwardly therefrom, said pair of corrugation lines being disposed intermediate said pair of end tabs;

said deck portion is formed and having a second opening therethrough for each of said end tabs, each said second opening being disposed along one of a second pair of opposite edges of said polygonal periphery; and said top wall of said central runner is formed as having a slot therethrough for and in registry with each said second opening, each of said end tabs being received through a corresponding said second opening and slot attaching the end walls of said wall portion to the floor surface of said deck portion.

12. The integrated container and pallet system of claim 2 wherein said deck portion further comprises a first flanged portion disposed about the polygonal periphery of said deck portion and extending upwardly from said floor surface, said flanged portion being configured to receive a portion of said upstanding wall portion therewithin.

13. The integrated container and pallet system of claim 2 further comprising a cover portion surmounting said upstanding wall portion, said cover portion having a planar cover surface with a generally polygonal margin and a second flanged portion disposed along said margin and extending downwardly therefrom, said flanged portion being configured to receive a portion of said wall portion therewithin.

14. The integrated container and pallet system of claim 6 wherein said deck portion further comprises a first flanged portion disposed about the polygonal periphery of said deck portion and extending upwardly from said floor surface, said flanged portion being configured to receive a portion of said upstanding wall portion therewithin.

15. The integrated container and pallet system of claim 14 further comprising a cover portion surmounting said upstanding wall portion, said cover portion formed as having a planar cover surface with a generally polygonal margin and a second flanged portion disposed along said margin and extending downwardly therefrom, said flanged portion being configured to receive a portion of said wall portion therewithin and to receive said first flanged portion therewithin when said wall portion is collapsed and disposed within the generally polygonal periphery of said deck portion.

16. The integrated container and pallet system of claim 6 further comprising a cover portion surmounting said upstanding wall portion, said cover portion formed as having a planar cover surface with a generally polygonal margin and a second flanged portion disposed along said margin and extending downwardly therefrom, said flanged portion being configured to receive a portion of said wall portion therewithin and to receive said deck portion therewithin when said wall portion is collapsed and disposed within the generally polygonal periphery of said deck portion.

17. The integrated container and pallet system of claim 2 wherein said first and said second runner are each notched to receive the fork of a forklift therethrough.

18. The integrated container and pallet system of claim 2 wherein said first and second runner are each formed as having a generally rectangular shape with a bottom wall disposed opposite said top wall, a pair of side walls extending between said top and said bottom wall, and a vertical central wall interposed between said side walls, each said top wall having at least one opening formed from pair of downwardly-disposed flaps having central slots, and each said central wall having quarter-round cutouts located at the longitudinal ends of the top wall openings, said central slots of said flaps engaging said quarter-round cutouts of said central wall.

19. The integrated container and pallet system of claim 18 wherein said first and said second each runner further comprise at least one generally U-shaped insert having a pair of oppositely disposed slotted flaps inserted into the top wall opening, said slotted flaps engaging said quarter-round cutouts of said central wall.

20. The integrated container and pallet system of claim 2 wherein said first and said second runner are each formed as having a generally rectangular shape with a bottom wall disposed opposite said top wall, a pair of side walls extending between said top and said bottom wall, and a vertical central wall having a generally S-shaped configuration interposed between said side walls and said top and bottom walls, each said top wall having openings formed from a pair of downwardly-disposed flaps having central slots, and each said central wall having quarter-round cutouts located at the longitudinal ends of the top wall openings, said central slots of said flaps engaging said quarter-round cutouts of said central wall.

21. A method of making an integrated container and pallet comprising the steps of:

(a) providing an upstanding wall portion having a pair of oppositely-disposed side walls, and a pair of oppositely-disposed end walls each extending between said side walls intermediate a first and a second edge fold line, each of said side walls having at least one side tab extending downwardly therefrom, and each of said end walls having a central vertical fold line disposed intermediate said first and said second edge fold line and being inwardly folded on said central and said first and second edge fold lines collapsing said wall portion;

(b) providing a deck portion formed as a generally planar member having an upper side forming a floor surface and a lower side forming a support surface, said planar member having edges forming a generally polygonal periphery and having a first opening therethrough for each said side tab, each said first opening being disposed along one of a first pair of opposite edges of said polygonal periphery;

(c) providing a first and a second runner each formed as having a top wall, each said top wall being attached to said lower support surface for supporting said deck portion between said first and second runner and having a slot therethrough for and in registry with each corresponding said first opening of said deck portion;

(d) inserting each said side tab from one of said side walls through a corresponding said first opening and slot;

(e) outwardly expanding the collapsed wall portion about each said central and each said first and second edge fold line to space apart said side and said end walls; and (f) inserting each said side tab from the other of said side walls into a corresponding said first opening and slot to attach said wall portion to the floor surface of said deck portion forming said integrated container and pallet.

22. The method of claim 21 wherein each of said side tabs is provided as being folded horizontally about a lower fold line thereof to form a generally upstanding retention member inwardly biased within each said corresponding first opening and slot, each said retention member delimiting the removal of each said side tab out of each said corresponding first opening and slot for effecting a substantially locking engagement therebetween.

23. The method of claim 21 wherein each of said end walls of said wall portion is provided as further having a pair of corrugation lines disposed intermediate said first and said second edge fold line, each of said central vertical fold lines being disposed intermediate a corresponding said pair of corrugation lines, and further comprising the step of:

(g) inwardly folding each of said end walls on said pair of corrugation lines forming a corrugated end wall portion.

24. The method of claim 21 further comprising the step before step (d) of:

providing at least one central runner having a top wall, said top wall being attached to said lower support surface of said deck portion intermediate and substantially parallel to said first and said second runner.

25. The method of claim 24 wherein each of said end walls of said wall portion is provided as further having at least one end tab extending downwardly therefrom, said deck portion is provided as further having a second opening therethrough for each said end tab, each said second opening being disposed along one of a second pair of opposite edges of said polygonal periphery, said top wall of said central runner is formed as having a slot therethrough for and in registry with each said second opening, and further comprising the step after step (e) of:

inserting each of said end tabs of said end walls through a corresponding said second opening and slot attaching the end walls of said wall portion to the floor surface of said deck portion.

26. The method of claim 23 further comprising the step before step (d) of:

providing at least one central runner having a top wall, said top wall being attached to said lower support surface of said deck portion intermediate and substantially parallel to said first and said second runner.

27. The method of claim 26 wherein each of said end walls of said wall portion is provided as further having a pair of end tabs extending downwardly therefrom, said pair of corrugation lines being disposed intermediate said pair of end tabs, said deck portion is provided as further having a second opening therethrough for each of said end tabs, each said second opening being disposed along one of a second pair of opposite edges of said polygonal periphery, said top wall of said central runner is formed as having a slot therethrough for and in registry with each said second opening, and further comprising the step after step (e) of:

inserting each of said end tabs of said end walls through a corresponding said second opening and slot attaching the end walls of said wall portion to the floor surface of said deck portion.

28. The method of claim 23 further comprising the step before step (d) of:

providing at least one central runner having a top wall, said top wall being attached to said lower support surface of said deck portion intermediate and substantially parallel to said first and said second runner.

29. The method of claim 28 wherein each of said end walls of said wall portion is provided as further having at least one end tab extending downwardly therefrom, said deck portion is provided as further having second opening therethrough, each said second opening disposed along one of a second pair of opposite edges of said polygonal periphery, said top wall of said central runner is formed as having a slot therethrough for and in registry with each said second opening, and further comprising the step after step (e) of:

inserting each said end tab through a corresponding said second opening and slot attaching the end walls of said wall portion to the floor surface of said deck portion.

* * * * *